US006829463B2

(12) United States Patent
Fujii et al.

(10) Patent No.: US 6,829,463 B2
(45) Date of Patent: Dec. 7, 2004

(54) TONER REPLENISHING METHOD WITH IMPROVED STORAGE AND SEPARATION UNITS

(75) Inventors: Ritsuo Fujii, Hachioji (JP); Seiji Yamaguchi, Hachioji (JP); Hiroshi Isokawa, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/348,434

(22) Filed: Jan. 21, 2003

(65) Prior Publication Data

US 2003/0142999 A1 Jul. 31, 2003

(30) Foreign Application Priority Data

Jan. 31, 2002 (JP) ..... 2002-023291

(51) Int. Cl.[7] ..... G03G 15/08
(52) U.S. Cl. ..... 399/258
(58) Field of Search ..... 399/252–255, 399/258, 260, 262, 292

(56) References Cited

U.S. PATENT DOCUMENTS 5,909,609 A * 6/1999 Yahata et al. ..... 399/258
5,950,055 A * 9/1999 Yahata et al. ..... 399/252
6,091,912 A * 7/2000 Kitajima et al. ..... 399/258 X
6,560,429 B2 * 5/2003 Bares et al. ..... 399/253

* cited by examiner

*Primary Examiner*—William J. Royer
(74) *Attorney, Agent, or Firm*—Muserlian, Lucas and Mercanti

(57) ABSTRACT

This invention relates to a toner replenishing method including the steps of conveying, from a toner storing section which forms a fluid mixture of toner and air, the fluid mixture to a toner separating section provided away from the toner storing section through toner supplying fluid conveying system, separating the toner from air in the toner separating section, and supplying the toner from the toner separating section to a developing unit, and a toner replenishing unit which practices the toner replenishing method. The toner replenishing method of the invention further includes the step of returning part of air separated from the toner from the toner separating section to the toner storing section by using a returning fluid conveying system. The toner replenishing unit of the present invention includes a returning fluid conveying system between the toner storing section and the toner separating section. A path through which the fluid mixture meanders in the toner separating section is formed in the toner separating section.

9 Claims, 5 Drawing Sheets

TONER REPLENISHING METHOD WITH IMPROVED STORAGE AND SEPARATION UNITS

BACKGROUND OF THE INVENTION

1. Field of the Invention

The present invention relates to an electro-photographic image forming apparatus and, more particularly, a toner replenishing method and unit.

2. Description of the Prior Art

In a high-speed image forming apparatus and color image forming apparatus, the toner storing section for storing toner has a large capacity, sometimes making it difficult to put it in the vicinity of a developing unit.

As a countermeasure against such a case, a toner replenishing technique is developed which conveys toner from a toner storing section to a developing unit in accordance with a toner conveying method called air conveyance that can convey the toner to a remote place (see Japanese Unexamined Patent Publication Nos. 7-219329, 10-97130, 10-268641, 10-299672, and the like).

The basic constituent elements of a toner replenishing unit utilizing air conveyance include a toner storing section, a fluid conveying means for conveying a fluid mixture of toner and air from the toner storing section, and a toner separating section for separating the toner from the conveyed fluid mixture.

In many toner replenishing units, part of the air separated from the toner is returned to the fluid conveying means without being discharged to the outside. In order to separate the toner, a filter that does not allow the toner to scatter to the outside is provided.

According to the toner replenishing technique disclosed in the above references and other Japanese Unexamined Patent Publications, the fluid mixture of the toner and air is conveyed from the toner storing section to the developing unit by a fluid conveying means such as a pump. In the prior art, a fluid conveying means comprised of a pump, which conveys the fluid mixture of air and toner from the toner storing section to the toner separating section is merely provided, and the toner conveying performance is not sufficiently high. When the toner storing section as the conveyance origin is located at a position far from the toner separating section as the conveyance destination, toner conveyance becomes difficult. Therefore, it is difficult to arrange the toner storing section at a position sufficiently away from the developing unit. In order to solve this problem, the pump must be large. When the pump is large, however, the exhaust air amount to the outside through the filter provided to the toner separating section increases. The amount of toner attaching to the filter increases, and the filter tends to undesirably clog at an early stage.

According to the conventional toner replenishing technique, as the interior of the toner separating section is in direct contact with the outside through the filter, the amount of toner filtered by the filter is large. This can cause the filter to clog at an early stage.

SUMMARY OF THE INVENTION

The present invention has been made in order to solve the problems of the toner replenishing technique utilizing conventional air conveyance, and has as its object to provide a toner replenishing method and unit with which a filter provided to a toner separating section causes less clogging and accordingly the performance of the filter can be maintained well over a long period of time, so that the storing section can be arranged away from the developing unit, and an image forming apparatus having such a toner replenishing unit.

In order to achieve the above object, according to the first aspect of the present invention, there is provided a toner replenishing method comprising the steps of conveying, from a toner storing section which forms a fluid mixture of toner and air, the fluid mixture to a toner separating section provided away from the toner storing section through toner supplying fluid conveying means, separating the toner from air in the toner separating section, and supplying the toner from the toner separating section to a developing unit, wherein the toner replenishing method further comprises the step of returning part of the air separated from the toner from the toner separating section to the toner storing section by using returning fluid conveying means.

According to the second aspect of the present invention, when the toner is to be separated from the air in the toner separating section, the fluid mixture of the toner and air is caused to meander in the toner separating section.

According to the third aspect of the present invention, there is provided a toner replenishing unit comprising a toner storing section which forms a fluid mixture of toner and air, toner supplying fluid conveying means for conveying the fluid mixture from the toner storing section, and a toner separating section which is provided away from the toner storing section and separates the fluid mixture into the toner and air, wherein the toner replenishing unit further comprises returning fluid conveying means for returning part of the air separated from the toner from the toner separating section to the toner storing section.

According to the fourth aspect of the present invention, each of the toner supplying fluid conveying means and the returning fluid conveying means according to the third aspect comprises a transport pipe and a pump provided midway along the transport pipe.

According to the fifth aspect of the present invention, the toner storing section according to the third aspect comprises a toner hopper which is connected to a toner container for storing the toner, and a mixing chamber which is connected to the toner hopper so as to mix the toner and air.

According to the sixth aspect of the present invention, the toner storing section according to the fourth aspect comprises a toner hopper which is connected to a toner container for storing the toner, and a mixing chamber which is connected to the toner hopper so as to mix the toner and air.

According to the seventh aspect of the present invention, there is provided a toner replenishing unit comprising a toner storing section which forms a fluid mixture of toner and air, toner supplying fluid conveying means for conveying the fluid mixture from the toner storing section, and a toner separating section which is provided away from the toner storing section and separates the fluid mixture into the toner and air, the toner separating section comprising an introducing chamber where the fluid mixture is introduced and separated into the toner and air, an exhaust chamber which communicates with the introducing chamber so as to discharge air separated from the toner, and a filter which is provided to a filter chamber communicating with the exhaust chamber, wherein the introducing chamber and the exhaust chamber communicate with each other through a meandering path.

According to the eighth aspect of the present invention, the toner replenishing unit according to the seventh aspect further comprises returning fluid conveying means which returns part of the air separated from the toner from the toner separating section to the toner storing section.

According to the ninth aspect of the present invention, there is provided an image forming apparatus comprising a developing unit which performs developing by using the toner replenishing unit according to any one of the third to eighth aspects and the toner replenished by the toner replenishing unit.

According to the tenth aspect of the present invention, there is provided an image forming apparatus comprising an image forming section which has a developing unit, a sheet feeding section which is provided below the image forming section, a toner storing section which is arranged below the image forming section and on a side of the sheet feeding section and forms a fluid mixture of toner and air, a toner separating section which is arranged away from the toner storing section and in the vicinity of the developing unit, a first transport pipe which transports the fluid mixture from the toner storing section to the toner separating section, a second transport pipe which returns part of the air separated from the toner in the toner separating section to the toner storing section, a fluid mixture conveying pump which is provided midway along the first transport pipe, and a returning air conveying pump which is provided midway along the second transport pipe.

As is apparent from the above aspects, according to the present invention, the following effects which are expected to contribute to this technical field remarkably can be obtained.

The fluid is circulated between the toner storing section and the toner separating section which separates the toner from the fluid mixture conveyed from the toner storing section, by the toner supplying fluid conveying means and the returning fluid conveying means. This increases the conveying performance of the toner.

Even when the toner storing section as the toner conveyance origin is arranged away from the toner separating section as the conveyance destination, the toner can be conveyed smoothly.

In the toner separating section, the amount of air flowing to the outside decreases, so that filter clogging is suppressed effectively. As a result, the service life or cleaning period of the filter can be prolonged. In addition, since air is circulated within the toner replenishing unit, it becomes possible to be unnecessary to discharge air outside, in other words, it becomes possible to disuse any filter.

The amount of toner in the fluid mixture in a flow path extending from the toner separating section to the outside is decreased, and after that air used for conveyance of the toner is discharged to the outside through the filter. Therefore, the amount of toner deposited on the filter can be decreased. As a result, the service life or cleaning period of the filter can be prolonged.

As the toner storing section can be arranged away from the developing unit, it can store a large amount of toner. A large-capacity toner storing section, which is necessary for a high-speed image forming apparatus or color image forming apparatus, can thus be provided.

The above and many other objects, features and advantages of the present invention will become apparent to those skilled in the art upon making reference to the following detailed description and accompanying drawings in which a preferred embodiment incorporating the principle of the present invention is shown by way of an illustrative example.

DETAILED DESCRIPTION OF THE PREFERRED EMBODIMENT

A preferred embodiment of the present invention will be described with reference to the accompanying drawings.

(1) Image Forming Apparatus

Figure 1:
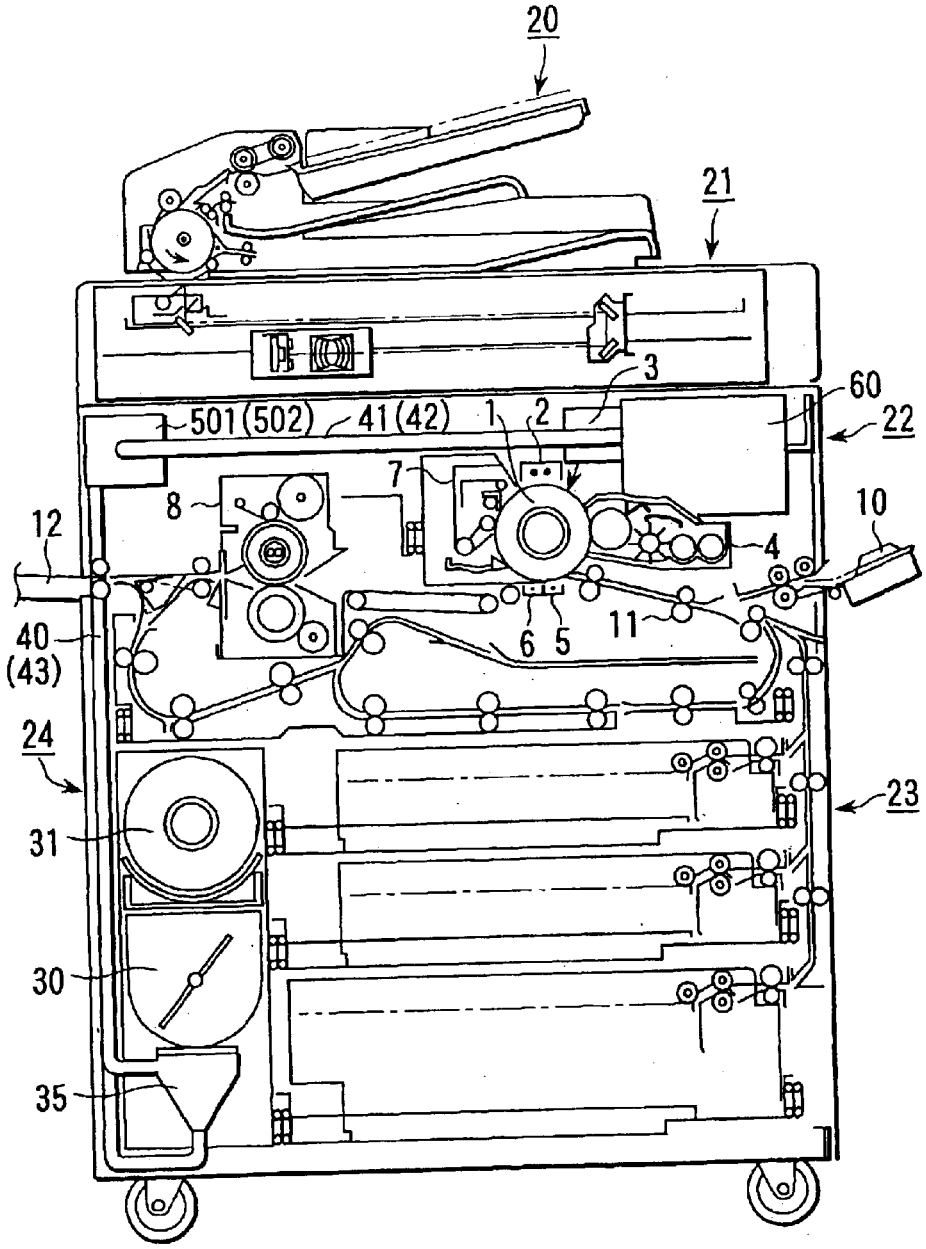
FIG. 1 is a front view showing the schematic overall arrangement of an image forming apparatus having a toner replenishing unit of the present invention.

Referring to FIG. 1, in an automatic document feeder 20, the documents placed on a document table are conveyed one by one to a reading position, and the documents after reading are stacked on a document delivery tray.

A document reading section 21 reads the image of the document and forms digital image data.

An image forming section 22 forms an image on a recording sheet by electrophotographing.

In the image forming section 22, a charging unit 2, exposure unit 3, developing unit 4, transfer unit 5, separation unit 6, and cleaning unit 7 are arranged around a drum-like photosensitive body 1. A sheet feeding section 23 having a plurality of recording sheet storing portions is formed below the image forming section 22, and feeds a recording sheet to the image forming section 22. Reference numeral 10 denotes a manual sheet feeding section. A recording sheet fed from the sheet feeding section 23 or manual sheet feeding section 10 is supplied to a portion between the photosensitive body 1 and transfer unit 5 by registration rollers 11, undergoes image fixing by a fixing unit 8, and is delivered to a delivery tray 12.

As the photosensitive body 1 rotates clockwise, a toner image is formed on the photosensitive body 1 by charging of the charging unit 2, image exposure of the exposure unit 3, and development of the developing unit 4. The formed toner image is transferred to the recording sheet by the transfer unit 5. The toner-image-bearing recording sheet is subjected to a fixing process by the fixing unit 8, and is delivered to the delivery tray 12.

The developing unit 4 develops an electrostatic latent image on the photosensitive body 1 with a two-component developing agent containing toner and carrier, or a one-component developing agent not containing a carrier but containing toner, or toner and an additive. The developing unit 4 stores a predetermined amount of developing agent. When a two-component developing agent is to be used, the toner consumed by development is replenished by a toner storing section 24 (to be described next), so that the toner concentration of the developing agent in the developing unit 4 always maintains a predetermined value. In a developing unit 4 using a one-component developing agent, the amount of developing agent in it always maintains a predetermined amount by similar toner replenishing.

A toner container 31 is mounted in the toner storing section 24. The toner storing section 24 has a toner hopper 30 and a funnel-like mixing chamber 35. A toner separating section 60 arranged in the vicinity of the developing unit 4 and the toner storing section 24 formed at a position away from the developing unit 4 are connected to each other through transport pipes 40 to 43.

(2) Toner Replenishing Unit

The toner storing section 24 will be described first with reference to FIGS. 2 and 3.

The toner replenishing unit is comprised of the toner storing section 24 (constituted by the toner hopper 30 and mixing chamber 35), pumps 501 and 502 serving as a fluid conveying means, the toner separating section 60, and the transport pipes 40 to 43.

The toner storing section 24 has the toner hopper 30 and the funnel-like mixing chamber 35. The cylindrical toner container 31 is mounted in the toner storing section 24. When the toner container 31 is driven to rotate by a motor 38, the toner drops from the toner container 31 into the toner hopper 30 through an opening 30*a*. The toner hopper 30 has a rod-like stirring member 32 with a plurality of U-shaped portions, and a screw 34 at its lower portion.

When the motor 39 rotates, the stirring member 32 and screw 34 rotate, and the toner drops from the toner hopper 30 into the mixing chamber 35 through an opening 30*b*.

Air is sent into the mixing chamber 35 through the transport pipe 43 as will be described later. Hence, a fluid mixture of the toner and air is formed.

Figure 4:
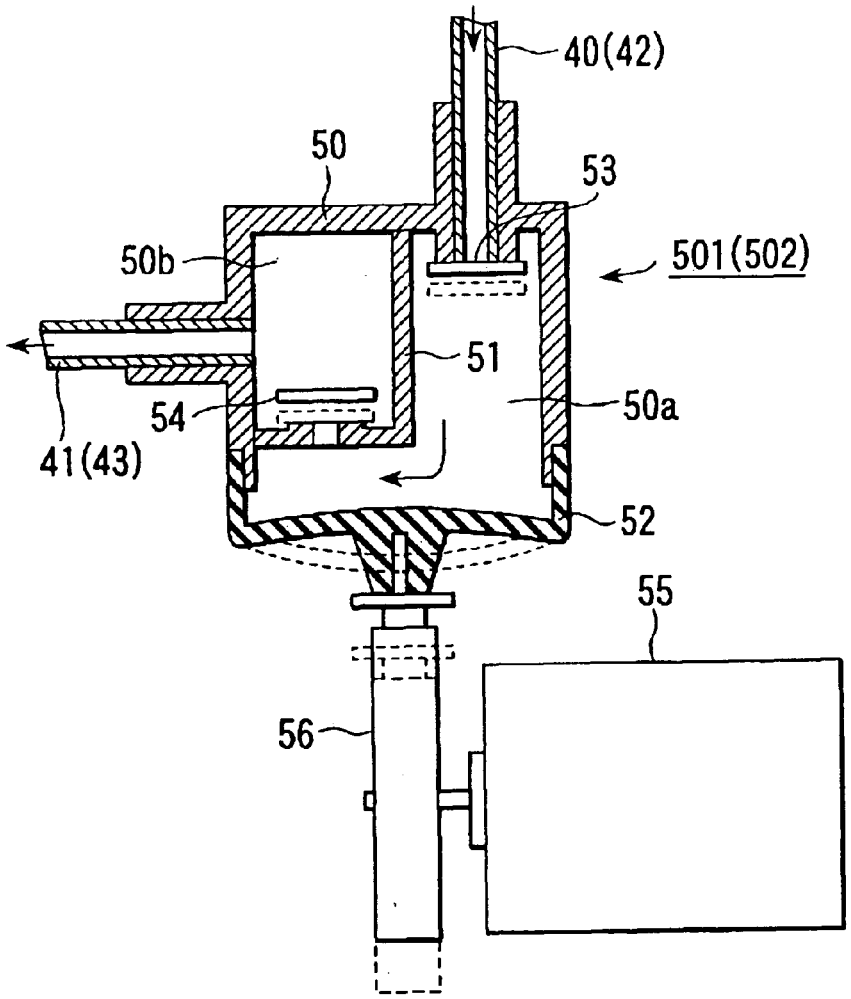
FIG. 4 is a longitudinal sectional view of a pump in the toner replenishing unit of the present invention.

As the fluid conveying means, the pumps 501 and 502 formed of diaphragm pumps shown in FIG. 4 are used. Alternatively, any known arbitrary pump such as the screw pump and fan disclosed in Japanese Unexamined Patent Publication Nos. 7-219329 and 8-6368 can be used. The pump 501 forms a toner supplying fluid conveying means which conveys the fluid mixture of the toner and air from the toner storing section 24 to the toner separating section 60. The pump 502 forms a returning fluid conveying means which returns air from the toner separating section 60 to the toner storing section 24. In FIG. 4, the pumps 501 and 502 having the same structure are used. Alternatively, different pumps may be used as the toner supplying fluid conveying means and the returning fluid conveying means.

The pumps 501 and 502 will be described with reference to FIG. 4. The pumps 501 and 502 have the same structure shown in FIG. 4.

The intake port of the pump 501 is connected to the transport pipe 40, and its exhaust port is connected to the transport pipe 41. The intake port of the pump 502 is connected to the transport pipe 42, and its exhaust port is connected to the transport pipe 43. A pump chamber formed by an outer wall 50 is partitioned by an inner wall 51 into an intake chamber 50*a* and an exhaust chamber 50*b*. A valve 53 is provided to the intake port of the intake chamber 50*a*, and a valve 54 is provided to the vent hole (vent hole formed in the inner wall 51) of the exhaust chamber 50*b*.

The outer shape of each of the pumps 501 and 502 is partly formed of a diaphragm 52 formed by an elastic body made of rubber. The diaphragm 52 is driven by an eccentric rotary member 56 driven by a motor 55, and deforms into a state indicated by a solid line and a state indicated by a broken line.

The motor 55 rotates the eccentric rotary member 56. Due to the rotation of the eccentric rotary member 56, the diaphragm 52 deforms between the state indicated by the solid line and the state indicated by the broken line. Thus, the capacity of the intake chamber 50*a* changes, and the pressure in the intake chamber 50*a* accordingly increases or decreases. Due to this increase or decrease of the pressure, the valves 53 and 54 deform into the state indicated by a solid line and a state indicated by a broken line, to convey the fluid in one direction indicated by arrows.

The toner separating section 60 will be described with reference to FIG. 5.

The toner separating section 60 is comprised of an outer wall 61 which limits the outer shape of the toner separating section 60, and inner walls 64 and 65 and a vertical section 65A of an inner wall 65 which separate the interior of the toner separating section 60 into an introducing chamber 60A and an exhaust chamber 60B. The exhaust chamber is formed of an exhaust portion 60B and a filter chamber 60C.

The introducing chamber 60A has an air inlet port 62, and the exhaust chamber 60B has an air discharge port 63. The auxiliary inner wall 66 guides dropping toner, and suppresses any upward movement of the toner. Stirring members 67 having blades and a screw 68 for conveying the toner in the axial direction are formed in the lower portion of the toner separating section 60. The air mixture of the toner and air is introduced from the air inlet port 62 into the introducing chamber 60A as indicated by an arrow W1, and drops as indicated by arrows W2. The fluid mixture fills the introducing chamber 60A. The fluid mixture receives the negative pressure of the fluid conveying force generated by the pump 502, and partly moves upward as indicated by arrows W3 and is conveyed to the exhaust chamber 60B. The toner concentration in the fluid mixture which moves upward decreases due to the specific gravity of the toner and the operation of the auxiliary inner wall 66, and the fluid mixture becomes a fluid mostly comprised of air. The fluid mixture in the exhaust chamber 60B is discharged from the air discharge port 63 as indicated by an arrow W4. Part of the fluid mixture in the exhaust chamber 6GB enters the filter chamber 60C as indicated by an arrow W5, and is filtered by a filter 69 and is discharged as indicated by arrow W6.

Figure 5:
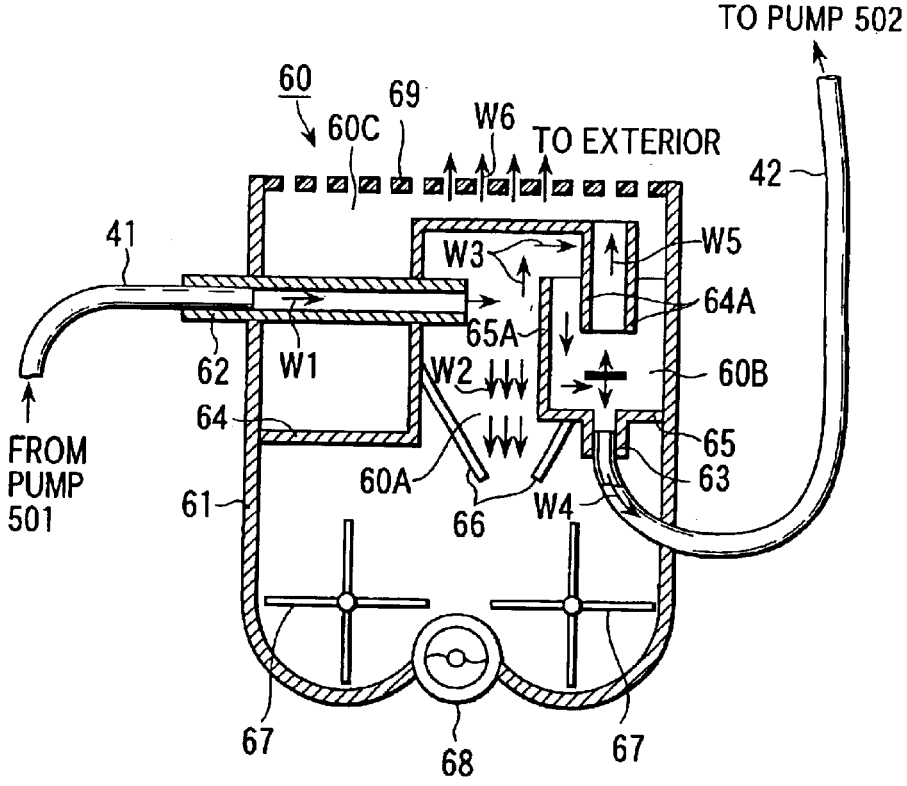
FIG. 5 is a longitudinal sectional view of a toner separating section in the toner replenishing unit of the present invention.

As shown in FIG. 5, a vertical portion 65A of the inner wall 65 and a vertical portion 64A of the inner wall 64 form a communicating path through which the fluid mixture meanders. Because of this meandering communication path, the toner content in the air to be discharged and that in the discharge fluid to be processed by the filter 69 are low. The vertical portions 65A and 64A are cylindrical, and the cylinder of the vertical portion 64A is arranged inside the cylinder of the vertical portion 65A.

Figure 2:
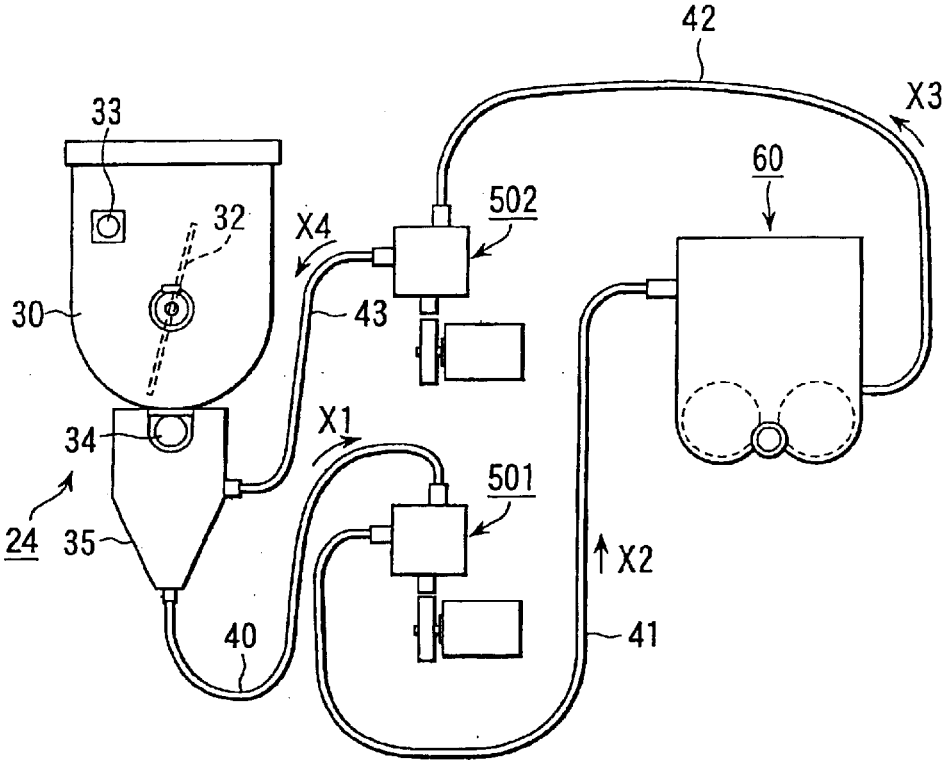
FIG. 2 is a schematic view showing a fluid circulating path in the toner replenishing unit of the present invention.

As shown in FIG. 2, the toner hopper 30, pumps 501 and 502, and toner separating section 60 are connected to each other through the transport pipes 40, 41, 42, and 43.

Due to the operation of the pump 501, the fluid mixture is conveyed from the toner hopper 30 to the pump 501 as indicated by an arrow X1 and from the pump 501 to the toner separating section 60 as indicated by an arrow X2, so that the toner is supplied. Due to the operation of the pump 502, air returns from the toner separating section 60 to the pump 502 as indicated by an arrow X3, and from the pump 502 to the toner hopper 30 as indicated by an arrow X4. The toner is then separated by the toner separating section 60, and the separated toner is supplied to the developing unit 4 by the screw 68.

The toner replenishing unit shown in FIGS. 2 to 5 operates in the following manner.

The toner amount in the toner hopper 30 is detected by a toner sensor 33 using a piezoelectric element. If the toner level becomes lower than that detected by the toner sensor 33 (see FIG. 2), the motor 38 is actuated to replenish more toner from the toner container 31 to the toner hopper 30.

Figure 3:
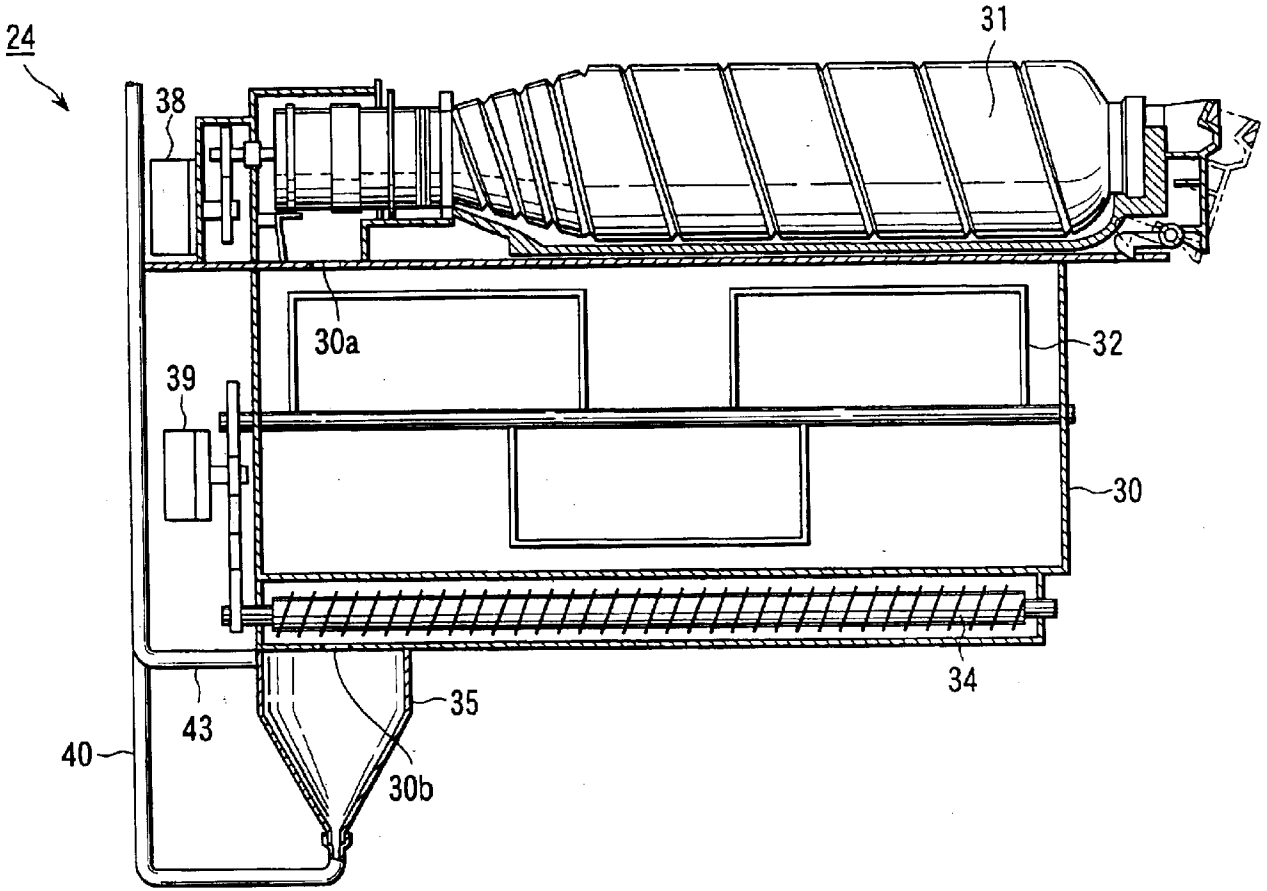
FIG. 3 is a partial sectional side view of a toner storing section in the toner replenishing unit of the present invention.

A replenish signal from a control means (not shown), which replenishes toner to the developing unit 4, actuates the motor 39 shown in FIG. 3. Thus, the stirring member 32 is driven to stir the toner in the toner hopper 30, and the screw 34 is driven so that the toner drops into the mixing chamber 35. The replenish signal actuates the motor 55, and the pumps 501 and 502 are actuated accordingly. When the pumps 501 and 502 are actuated, an air current occurs in the mixing chamber 35, and the toner and air are mixed. The fluid mixture is conveyed to the toner separating section 60 through the transport pipes 40 and 41 by the conveying force of the pump 501.

As shown in FIG. 5, the toner separated by the toner separating section 60 is supplied to the developing unit 4 by the screw 68. The separated air returns to the mixing chamber 35 through the transport pipes 42 and 43 by the conveying force of pump 502.

What is claimed is:

1. A toner replenishing method comprising the steps of conveying, from a toner storing section which forms a fluid mixture of toner and air, the fluid mixture to a toner separating section provided away from the toner storing section through toner supplying fluid conveying means, separating the toner from air in the toner separating section, and supplying the toner from the toner separating section to a developing unit, wherein the toner replenishing method further comprises the step of returning part of air separated from the toner from the toner separating section to the toner storing section by using returning fluid conveying means, wherein the toner separating section is divided into an introducing chamber and an exhaust chamber by a wall and wherein the introducing chamber communicates with the exhaust chamber through a meandering path, the meandering path being formed with the wall disposed between the introducing chamber and the exhaust chamber.

2. A toner replenishing unit comprising a toner storing section which forms a fluid mixture of toner and air, toner supplying fluid conveying means for conveying the fluid mixture from said toner storing section, and a toner separating section which is provided away from said toner storing section and separates the fluid mixture into the toner and air, wherein the toner replenishing unit further comprises returning fluid conveying means for returning part of air separated from the toner from said toner separating section to said toner storing section, wherein the toner separating section is divided into an introducing chamber and an exhaust chamber by a wall and wherein the introducing chamber communicates with the exhaust chamber through a meandering path, the meandering path being formed with the wall disposed between the introducing chamber and the exhaust chamber.

3. A unit according to claim 2, wherein each of said toner supplying fluid conveying means and said returning fluid conveying means comprises a transport pipe and a pump provided midway along the transport pipe.

4. A unit according to claim 3, wherein said toner storing section comprises a toner hopper which is connected to a toner container for storing the toner, and a mixing chamber which is connected to said toner hopper so as to mix the toner and air.

5. A unit according to claim 2, wherein said toner storing section comprises a toner hopper which is connected to a toner container for storing the toner, and a mixing chamber which is connected to said toner hopper so as to mix the toner and air.

6. An image forming apparatus comprising a developing unit which develops by using the toner replenishing unit according to claim 2, and the toner replenished by the toner replenishing unit.

7. A toner replenishing unit including a toner storing section which forms a fluid mixture of toner and air, toner supplying fluid conveying means for conveying the fluid mixture from said toner storing section, and a toner separating section which is provided away from said toner storing section and separates the fluid mixture into the toner and air, the toner separating section comprising:

an introducing chamber where the fluid mixture is introduced and separated into the toner and air;

an exhaust chamber which communicates with said introducing chamber so as to discharge air separated from the toner;

a filter which is provided to a filter chamber communicating with said exhaust chamber and;

a wall which divides the toner separating section into the introducing chamber and the exhaust chamber, wherein said introducing chamber and said exhaust chamber communicate with each other through a meandering path, the meandering path being formed with the wall disposed between the introducing chamber and the exhaust chamber.

8. A unit according to claim 7, further comprising returning fluid conveying means for returning part of air separated from the toner from said toner separating section to said toner storing section.

9. An image forming apparatus comprising an image forming section which has a developing unit, a sheet feeding section which is provided below said image forming section, a toner storing section which is arranged below said image forming section and on a side of said sheet feeding section and forms a fluid mixture of toner and air, a toner separating section which is arranged away from said toner storing section and in the vicinity of said developing unit, a first transport pipe which transports the fluid mixture from said toner storing section to said toner separating section, a second transport pipe which returns part of air separated from the toner in said toner separating section to said toner storing section, a fluid mixture conveying pump which is provided midway along said first transport pipe, and a returning air conveying pump which is provided midway along said second transport pipe, wherein the toner separating section is divided into an introducing chamber and an exhaust chamber by a wall and wherein the introducing chamber communicates with the exhaust chamber through a meandering path, the meandering path being formed with the wall disposed between the introducing chamber and the exhaust chamber.

* * * * *